US005242170A

United States Patent [19]

Ward

[11] Patent Number: 5,242,170

[45] Date of Patent: Sep. 7, 1993

[54] GOLF TEE

[75] Inventor: Richard E. Ward, South Euclid, Ohio

[73] Assignee: Super Tee, Inc., Cleveland, Ohio

[21] Appl. No.: 883,260

[22] Filed: May 14, 1992

[51] Int. Cl.[5] ..... A63B 57/00

[52] U.S. Cl. ..... 273/207; 273/212; 273/208

[58] Field of Search ..... 273/201-212, 273/33, 26 R, 29 A

[56] References Cited

U.S. PATENT DOCUMENTS

| | | | |
|---|---|---|---|
| 638,920 | 12/1899 | Grant . | |
| 1,519,298 | 12/1924 | De Mun . | |
| 1,550,483 | 8/1925 | Wulkop . | |
| 1,981,810 | 11/1934 | Parkhurst | 273/33 |
| 2,146,736 | 2/1939 | Hammond et al. . | |
| 2,440,473 | 4/1948 | Hughes . | |
| 2,470,817 | 5/1949 | Hendricks . | |
| 2,531,470 | 11/1950 | Rickard . | |
| 2,723,126 | 11/1955 | Spluvak . | |
| 2,839,304 | 6/1958 | Lerick . | |
| 3,414,268 | 12/1968 | Chase . | |
| 3,559,998 | 2/1971 | Kelly . | |
| 3,633,919 | 1/1972 | Liccardello . | |
| 3,645,537 | 2/1972 | Parenteau . | |
| 4,516,780 | 5/1985 | Tabet . | |
| 4,524,974 | 6/1985 | Matsuura . | |
| 4,610,451 | 9/1986 | Keys | 273/33 |
| 4,645,208 | 2/1987 | Morabeto . | |
| 4,786,054 | 11/1988 | Keys | 273/33 |
| 4,905,999 | 3/1990 | Volnovich et al. . | |
| 4,976,431 | 12/1990 | Guenther . | |
| 4,989,869 | 2/1991 | Lackey . | |

FOREIGN PATENT DOCUMENTS

| | | | |
|---|---|---|---|
| 431204 | 7/1935 | United Kingdom | 273/207 |
| 483599 | 4/1938 | United Kingdom | 273/33 |

*Primary Examiner*—Theatrice Brown

*Attorney, Agent, or Firm*—Gerstman & Ellis, Ltd.

[57] ABSTRACT

A two-piece, realignable golf tee comprises a lower, integrally molded plastic piece comprising a ground spike, a central flange, a relatively thin, flexible retainer shaft extending away from the ground spike in substantially parallel relation, and an enlargement adjacent the outer end of the retainer shaft. An upper, integrally molded plastic piece comprises a sleeve slidably positioned about the flexible retainer shaft. The sleeve defines a bore having a constricted portion adjacent a first sleeve end that faces the ground spike to engage the enlargement, to substantially limit movement of the sleeve away from the spike and out of engagement with the retainer shaft. The central flange is proportioned to serve as a seat for the first sleeve end, with the end of the sleeve opposed to the first end being proportioned to serve as a seat for a golf ball. The two, integrally molded plastic pieces may be assembled in snap-fit relation.

13 Claims, 1 Drawing Sheet 32
34
36
26
24
22
10
28
18
30
20
12
16
14
38
26a
10a
22a
28a
24a
12a
40
14a

GOLF TEE

BACKGROUND OF THE INVENTION

Two-piece golf tees are known as described, for example, in the following U.S. Patents among others: Lerick U.S. Pat. No. 2,839,304; Kelly U.S. Pat. No. 3,559,998; Morabeto U.S. Pat. No. 4,645,208; and Matsuura U.S. Pat. No. 4,524,974. Each of these golf tees comprise a spike, and an upper portion which is displaceable relative to the spike, whereby, when the golf ball is struck, if the top of a golf tee is also struck by the club it typically displaces without digging the spike out of the dirt. This avoids the consumption of energy from the golf swing by such digging of the spike out of its seat in the dirt, resulting in an increased transfer of energy from the club to the ball that can result in increased golf ball driving distances.

Also, there has been sold in the United States a golf tee which comprises a ground spike, to which there is attached by a screw a longitudinally slit piece of rubbery, elastic plastic tubing having an enlarged outer end. A plastic sleeve is captured by this rubbery, elastic tubing, with the plastic sleeve having an internal flange in its bore to permit sliding of the sleeve along the rubbery, elastic tube while preventing removal of the sleeve from the engagement with the rubbery, elastic tube. Also, the outer end of the captured plastic sleeve has a plastic partition across the bore, sealed in position.

Such a tee as described above comprises five separate parts, which are assembled typically by hand into a single golf tee which has a displaceable upper portion, exhibiting advantages as described above.

In accordance with this invention, a typically two-piece golf tee is provided which exhibits a greatly reduced manufacturing cost when compared with the golf tee described immediately above. Each of the two parts of the tee of this invention may be molded on a low cost, high volume basis. The two parts may be assembled by a simple snap-fitting operation, to provide a displaceable-top golf tee in which the top is, nevertheless, essentially permanently attached to the spike portion so that the top does not get lost. Such independent action of the golf tee of this invention results in minimal resistance between the tee, club, and ball upon impact. This can mean longer yardage and greater accuracy on drives. Also, the chances are greatly reduced that the tee is dug out of the ground by the golf swing. Rather, the spike remains firmly emplaced in the ground, while the top portion displaces, absorbing a smaller amount of energy and getting more quickly out of the way of the club swing.

Thereafter, the upper portion of the tee of this invention often spontaneously resets or otherwise can be quickly reset, often without having to replace the spike in the ground, for reuse.

Thus, by this invention fewer tees are lost, and golf play is faster without the inconvenience of looking for missing tees. Also there is less clutter on the golf course of lost tees and fragments thereof, minimizing interference with course grooming equipment.

Additionally, the top portion of the tee of this invention is ideally suitable for imprinting names, logos, and messages, for example for purposes of advertising. Unlike other tees, these messages will be seen during the golf driving process, since they are not buried in the ground on the tee spike.

DESCRIPTION OF THE INVENTION

By this invention a two-piece, realignable golf tee is provided. The term "realignable" implies that the tee may be reused by simple and easy resetting of the two tee pieces together, so that repeated drives may be made off of the same tee, often without having to reset the tee into the ground.

The tee of this invention comprises a lower, integrally-molded plastic piece which comprises a ground spike, a central flange on the ground spike, and a relatively thin, flexible retainer shaft extending away from the ground spike in substantially parallel relation therewith. The retainer shaft defines an enlargement adjacent an outer end thereof.

Additionally, the tee of this invention comprises an upper, integrally molded plastic piece which comprises a sleeve which is slidably positioned about the flexible retainer shaft. The sleeve defines a bore having a constricted portion adjacent a first sleeve end that faces the ground spike, to engage the enlargement, which substantially limits the movement of the sleeve away from the spike so that the sleeve can move longitudinally with respect to the spike, but only to a limited extent. The central flange of the lower plastic piece is proportioned to serve as a seat for the first sleeve end, so that it may be typically frictionally retained thereon. The end of the sleeve opposed to the first end is proportioned to serve as a seat for a golf ball.

Preferably, the diameter of the retainer shaft is no more than one-half the minimum inner diameter of the sleeve, this relationship being particularly significant for the outer half of the retainer shaft. Also, the enlargement is preferably of lesser outer diameter than the inner diameter of the sleeve. Particularly, the difference between the outer diameter of the enlargement and the inner diameter of the sleeve is preferably at least equal to one wall thickness of the sleeve.

The advantage of this is that under such circumstances the sleeve is capable of tilting after it has been moved outwardly out of its seated relationship with the lower molded plastic piece, to a significant degree without creating tension in the system that uses energy from the golf swing. Thereafter, the system is capable of further bending or deflecting, particularly as shown in FIG. 3, with only a minimal amount of tension. Typically, after the golf swing the tee of this invention can snap back into its original, seated configuration of FIG. 2. However, if it happens not to snap back into the completely seated configuration, seating can be easily accomplished as another golf ball is placed upon the tee.

Typically, the upper, integrally molded sleeve may be made of polyvinyl chloride or the like, which preferably has a softer durometer and higher elongation than the lower, molded plastic piece which forms the spike and retainer shaft. Particularly, the lower, molded plastic piece may be made of du Pont Zytel 101 brand of nylon, having a higher durometer and lower elongation than the polyvinyl chloride sleeve Preferably, the central flange of the golf tee of this invention is of essentially the inner diameter of the sleeve at the first end, so that the sleeve can be firmly and frictionally seated on the central flange within the sleeve bore.

Also, a second flange is preferably positioned adjacent to the central flange to engage the first sleeve end a the central flange occupies the sleeve bore.

It is also preferred for the sleeve to define an integral, closed top wall adjacent the opposed sleeve end, which typically is a co-molded part of the unitary sleeve.

DESCRIPTION OF SPECIFIC EMBODIMENTS

Figures 1, 2, 3, 4:
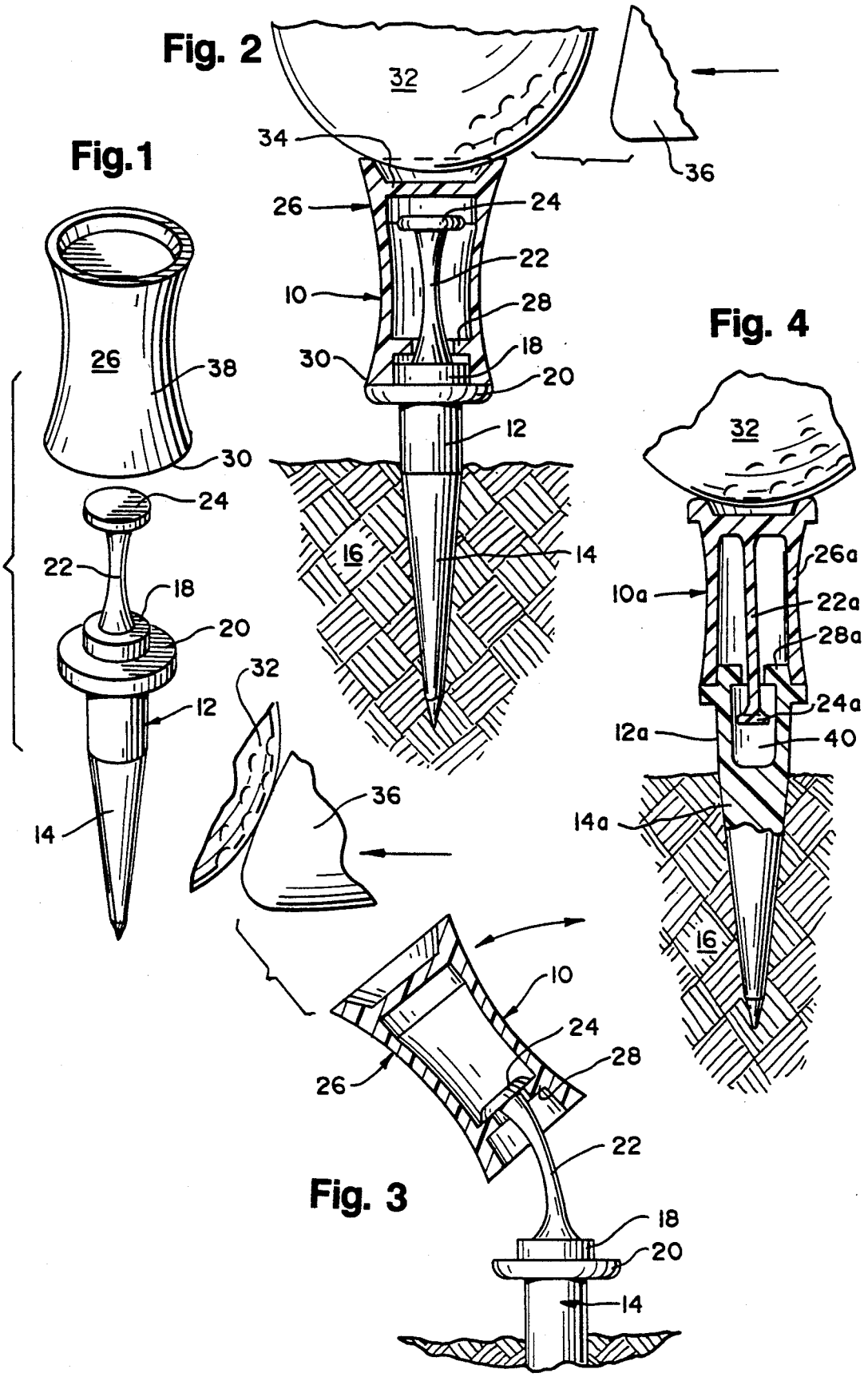
FIG. 1 is an exploded perspective view of the two-part golf tee of this invention.
FIG. 2 is a perspective view, taken partly in section, showing the assembled golf tee embedded in the ground and carrying a golf ball, prior to striking by a golf club.
FIG. 3 is an elevational view similar to FIG. 2, showing the golf tee immediately after the golf ball has been hit by a club.
FIG. 4 is an elevational view taken partly in section similar to FIG. 2, but showing another embodiment of the golf tee of this invention.

Referring to FIGS. 1 through 3, golf tee 10 of this invention is shown to be made of only two separate, molded parts, contrary, for example, to the five component golf tee of the prior art.

A lower, integrally-molded plastic spike 12 is shown, this individual part being capable of being manufactured by high speed, low cost injection molding. Lower plastic piece 12 comprises, as integral components thereof, a ground spike 14, shown in FIG. 2 in its function of penetrating the ground 16 in the manner of a conventional golf tee. Integral central flange 18 is positioned at a central location of the tee, with a larger-diameter second flange 28 being provided between central flange 18 and spike 14.

A flexible retainer shaft 22 is positioned to extend away from ground spike 14 in substantially coaxial relation therewith. Shaft 22 is an integrally molded part of lower plastic piece 12, but because of its reduced diameter as shown, it exhibits a measure of flexibility, being substantially flexible while the remainder of plastic piece 12 is substantially rigid.

At the outer end of flexible retainer shaft 22, an integral enlargement 24 is provided.

The second part of the golf tee 10 is an upper, integrally molded plastic sleeve 26 which, as shown in FIGS. 2 and 3, is slidably positioned about the flexible retainer shaft 22. Sleeve 26 defines a bore having a constricted portion defined by typically an internal, annular sleeve 28, positioned about flexible retainer shaft 22. Flange or constriction 28 is adjacent first sleeve end 30 that faces ground spike 14. Constriction 28 is proportioned to engage enlargement 24 of retainer shaft 22, to substantially limit movement of sleeve 26 away from the spike, which is the situation as illustrated in FIG. 3.

The lower and upper plastic pieces 12, 26 may be assembled by a simple snap-fit action after they have been molded, to go from the configuration of FIG. 1 to that of FIG. 2. Thus, a simple, inexpensive two-piece golf tee having a deflectable top is provided, with a great simplification of the various structures of the prior art, and is of very low manufacturing cost.

As shown in FIG. 2, golf tee 10 may be placed into the ground in the conventional manner of a golf tee, and a golf ball 32 may be placed on its upper end, which, as shown, acts as a seat for the golf ball. The golf tee specifically shown defines an integrally molded upper transverse wall 34, or if desired, such wall may be absent.

The first sleeve end 30 is shown to be firmly and frictionally seated in FIG. 2 on central flange 18 in the bore of sleeve 26, while second flange 20 can abut the actual end 30 of sleeve 26, for a solid but removable, seated retention of sleeve 26 on the lower part 12.

FIG. 2 shows the golf tee and carried golf ball 32 one instant before contact by a swinging club head 36, shown in fragmentary manner.

Then, FIG. 3 shows the same tee 10 an instant after ball 32 has been struck by club head 36. The upper plastic piece 26 may have been struck by club head 36 as well, which typically causes a conventional one-piece tee to fly out of the ground, which consumes energy. The tee can sometimes fly a considerable distance with the ball. However, as shown in FIG. 3, what happens instead with the tee of this invention is that upper plastic piece 26 flies loose from its seating on flanges 18, 20, to fly outwardly along flexible retainer shaft 22, with shaft 22 deflecting as necessary to cause upper plastic piece 26 to be deflected out of the wa of the moving club head 36. Little of the energy from the club head is transferred to the lower, molded plastic piece 14, which typically retains its seated position in the ground. Also, relatively little energy is transferred to upper plastic piece 26 because that small piece of plastic has little mass to receive energy, and likewise little energy is consumed in the flexing of retainer shaft 22.

Thus, less energy is transferred from the club to the tee of this invention under typical circumstances than takes place with a single component tee which is pivoted out of the ground through the dirt, sending both dirt and the tee flying. Thus, energy which may be consumed in pivoting a tee out of the ground and sending it flying instead stays with the club head and the ball for an improved shot. Additionally, the tee tends to remain seated in the ground, so that the user can merely place upper plastic piece 26 back on the respective flanges 18, 20 of the lower plastic piece 14, and the tee is ready to receive another golf ball.

Typically, enlargement 24 may have a diameter on the order of 0.28 inch, while the open aperture diameter of constriction 28 may be about 0.18 inch, for firm retention of enlargement 24, but permitting snap fit assembly. The minimum diameter of retainer shaft 22 may be about 0.075 inch. The remaining dimensions of tee 10 may be of an order so that the tee has dimensions that approximate the length of a conventional golf tee, with the outer diameter of the upper, ball seat end being for example 0.62 inch, and the inner diameter at partition 34 being essentially 0.38 inch. The tee specifically disclosed has a ball seat which is somewhat wider then that of a conventional wooden tee, to provide added stability to the seated ball.

After striking as shown in FIG. 3, shaft 22 tends to snap back to a coaxial relationship with ground spike 14. However, even if a small amount of deviation remains in shaft 22, the tee is easily assembled into its seated position of FIG. 2, manually either before or as golf ball 32 is applied to be seated on the tee.

If desired, advertising indicia or the like may be placed on the outer surface 38 of plastic sleeve 26, or any other desired indicia. Such indicia remain visible as the tee is inserted into the ground, to continue to display the desired message. Thus, the tee of this invention exhibits significant advantages at a significantly reduced manufacturing cost, as described above.

Referring to FIG. 4 an alternate design tee 10*a* of this invention is disclosed. In this embodiment, upper, integrally molded plastic piece 26a may be similar in design and spirit to that of the previous embodiment except that the retainer shaft 22a is carried by upper, molded piece 10a, and not by lower, molded piece 12a as in the previous embodiment. To accomplish this, enlargement 24a is positioned on the other end of retainer shaft 22a, residing in a bore 40 positioned within ground spike 14a. Lower piece 12a has a constricted bore portion 28a to limit the outward motion of upper plastic piece 10a by the inner action of enlargement 24a against constricted portion 28a. Portion 28a also provides a seat for tubular plastic piece 26a as shown.

As before, both pieces 10a and 14a may be integrally molded.

Thus, as in the previous embodiment, tee 10a is placed into the ground 16, and golf ball 32 is placed upon the upper seat thereof as shown in FIG. 4, to provide a two component, deflectable tee having advantages as previously described.

The above has been offered for illustrative purposes only, and is not intended to limit the scope of the invention of this application, which is as defined in the claims below.

That which is claimed is:

1. A two-piece, realignable golf tee, which comprises:

a lower, integrally-molded plastic piece which comprises: a ground spike, a central flange, and a relatively thin, flexible retainer shaft extending away from said ground spike in substantially parallel relation therewith, said retainer shaft defining an enlargement adjacent an outer end thereof; and an upper integrally molded plastic piece which comprises: sleeve, slidably positioned about said flexible retainer shaft, said sleeve defining a bore having a constricted portion adjacent a first sleeve end that faces said ground spike, said enlargement being positioned in said bore and being larger than said constricted portion whereby said constricted portion will engage said enlargement to limit movement of the sleeve a predetermined distance away from said spike, said central flange being proportioned to serve as a seat for said first sleeve end, the end of said sleeve opposed to said first end being proportioned to serve as a seat for a golf ball.

2. The golf tee in which said central flange has a dimension essentially that of the inner diameter of said sleeve at the first end, whereby said sleeve can be firmly and frictionally seated with said central flange positioned within the sleeve bore.

3. The golf tee of claim 2 in which a second flange is positioned adjacent to the central flange to engage the first sleeve end as the central flange occupies the sleeve bore.

4. The golf tee of claim 1 in which said sleeve defines an integral, closed top wall adjacent said opposed sleeve end.

5. The golf tee of claim 1 in which said sleeve carries message indicia on an outer wall thereof.

6. The golf tee of claim 1 in which said retainer shaft has a diameter of no more than one-half the diameter of said sleeve.

7. The golf tee of claim 1 in which the plastic of said upper plastic piece has a lower durometer and higher elongation than the plastic of said lower plastic piece.

8. A two-piece, realignable golf tee which comprises:

a lower, integrally-molded plastic piece which comprises a ground spike, a central flange, and a relatively thin, flexible retainer shaft extending away from the ground spike in substantially parallel relation therewith, said retainer shaft defining an enlargement adjacent an outer end thereof; and an upper, integrally-molded plastic piece which comprises:

a sleeve, slidably positioned about said flexible retainer shaft, said sleeve defining a bore having a constricted portion adjacent a first sleeve end that faces said ground spike, said enlargement being positioned in said bore and being larger than said constricted portion whereby said constricted portion will engage said enlargement to limit movement of the sleeve as predetermined distance away from said spike, said central flange being of essentially the inner diameter of said sleeve at the first end, to serve as a seat for said first sleeve end by frictional seating of the sleeve bore on said central flange, the end of said sleeve opposed to said first end being proportioned to serve as a seat for a golf ball, said sleeve also defining an integral, closed top wall adjacent said opposed sleeve end.

9. The golf tee of claim 8 in which a second flange is positioned adjacent to the central flange to engage the first sleeve end as the central flange occupies the sleeve bore.

10. The golf tee of claim 9 in which said sleeve carries message indicia on an outer wall thereof.

11. The golf tee of claim 8 in which said sleeve carries message indicia on an outer wall thereof.

12. The golf tee of claim 8 in which said retainer shaft has a diameter of no more than one-half the diameter of said sleeve.

13. The golf tee of claim 12 in which the plastic of said upper plastic piece has a lower durometer and higher elongation than the plastic of said lower plastic piece.

* * * * *